US007038572B2

(12) United States Patent
Huber et al.

(10) Patent No.: US 7,038,572 B2
(45) Date of Patent: May 2, 2006

(54) POWER CHIP RESISTOR

(75) Inventors: Louis Peter Huber, Valencia, CA (US); Ziv Shoshani, Tel-Aviv (IL)

(73) Assignee: Vishay Dale Electronics, Inc., Columbus, NE (US)

( * ) Notice: Subject to any disclaimer, the term of this patent is extended or adjusted under 35 U.S.C. 154(b) by 0 days.

(21) Appl. No.: 09/811,844

(22) Filed: Mar. 19, 2001

(65) Prior Publication Data

US 2002/0130762 A1 Sep. 19, 2002

(51) Int. Cl.
*H01C 1/012* (2006.01)

(52) U.S. Cl. ..... 338/309; 338/239; 338/319

(58) Field of Classification Search ..... 338/239, 338/260, 319, 320, 332, 313, 20, 21, 22 R, 338/22 SD
See application file for complete search history.

(56) References Cited

U.S. PATENT DOCUMENTS

| | | | | | |
|---|---|---|---|---|---|
| 3,474,305 | A | * | 10/1969 | Szupillo | 257/30 |
| 3,515,958 | A | * | 6/1970 | Claypoole et al. | 338/313 |
| 4,174,513 | A | * | 11/1979 | Wellard | 338/312 |
| 4,601,382 | A | * | 7/1986 | Roberts et al. | 198/432 |
| 5,397,916 | A | * | 3/1995 | Normington | 257/686 |
| 5,430,429 | A | * | 7/1995 | Nakamura et al. | 338/226 |
| 5,757,076 | A | * | 5/1998 | Kambara | 257/724 |
| 5,777,541 | A | * | 7/1998 | Vekeman | 338/313 |
| 5,818,107 | A | * | 10/1998 | Pierson et al. | 257/723 |
| 5,966,067 | A | * | 10/1999 | Murakami et al. | 338/309 |
| 6,084,502 | A | * | 7/2000 | Ariga et al. | 338/195 |
| 6,150,920 | A | * | 11/2000 | Hashimoto et al. | 338/309 |
| 6,311,390 | B1 | * | 11/2001 | Abe et al. | 338/313 |
| 6,348,852 | B1 | * | 2/2002 | Kojima et al. | 338/22 R |
| 6,362,723 | B1 | * | 3/2002 | Kawase | 338/22 R |
| 6,400,251 | B1 | * | 6/2002 | Abe et al. | 338/22 R |
| 2002/0125982 | A1 | * | 9/2002 | Swensen et al. | 338/22 R |

FOREIGN PATENT DOCUMENTS

| | | | |
|---|---|---|---|
| DE | 40 30 479 A 1 | | 4/1992 |
| JP | 63296201 | | 12/1988 |
| JP | 2-270302 | * | 11/1989 |
| JP | 4-214601 | * | 8/1992 |
| JP | 6-283301 | * | 10/1994 |
| JP | 11016703 | | 1/1999 |
| WO | WO 98/38652 | | 3/1998 |
| WO | WO 99/53505 | | 10/1999 |

OTHER PUBLICATIONS

Handbook of Thick Film Technology, Holmes et al. pp. 137-141 (1976).*

* cited by examiner

*Primary Examiner*—Tu Hoang
(74) *Attorney, Agent, or Firm*—McKee, Voorhees & Sease, P.L.C.

(57) ABSTRACT

A method and apparatus for a stacked power chip resistor is disclosed. The invention provides for multiple power chip resistors to be stacked, providing for encapsulant such as glass to separate each power chip resistor and a metal barrier such as nickel plating on each end of the stacked power chip resistor to provide for electrical and mechanical connection of each power chip resistor in the stack.

17 Claims, 4 Drawing Sheets

POWER CHIP RESISTOR

BACKGROUND OF THE INVENTION

A. Field of the Invention

This invention relates to power chip resistors. More specifically the invention relates to an improved power chip resistor with increased power dissipation in a small package.

B. Problems in the Art

Power resistors, chip resistors, and power chip resistors have numerous applications in electronic circuits including limiting current. The problem of limiting current or otherwise using a power chip resistor is sometimes in conflict with the amount of board space that can be allocated for the resistor. In order to increase the power dissipation of a chip resistor, the size of the resistor is increased. As electronic devices continue to decrease in size, board space and the need to reduce board space increases. Thus there is a problem in using a power chip resistor when there is limited board space.

Some attempts have been made at stacking chip resistors. A stacked chip resistor would reduce the amount of board space required as the size of the resistor would increase vertically. These attempts have created additional problems.

One such problem is that these attempts have used epoxy or other resins or polymers as an adhesive to physically connect each chip resistor in the stack. Epoxy is widely used as an adhesive in the art but has certain qualities that make it ineffective for stacking power chip resistors. In particular, long term use of epoxy or other polymers in a power chip resistor may result in an electrical instability effect over time due to the effects of resistive heating.

Another problem relates to the use of solder at the terminals of a stacked chip resistor. The magnitude of the resistive heating can be so great, particularly in high wattage power chip resistors, that when stacked, the solder melts. Because solder would melt, the power chip resistor would not be compatible with standard manufacturing practices and methods concerning population of components on a circuit board. In particular, standard flowing processes could not be used as the power chip resistor would not be flow solderable. Thus any accommodation of a power chip resistor into a circuit design would involve additional manufacturing costs.

It is therefore an objective of the present invention to provide an apparatus and method of making a power chip resistor that improves upon the state of the art.

It is a further objective of the present invention to provide a power chip resistor and method of making a power chip resistor that permits a power chip resistor to be made that requires reduced circuit board space.

It is a further objective of the present invention to provide a power chip resistor and method of making a power chip resistor that provide the capability of increased power dissipation.

It is a further objective of the present invention to provide a power chip resistor and method of making a power chip resistor that provide for stacking power chip resistors.

It is a further objective of the present invention to provide a power chip resistor and method of making a power chip resistor that provides for a resistor with a higher power rating.

It is a further objective of the present invention to provide a power chip resistor capable of use at high voltages.

It is a further objective of the present invention to provide a power chip resistor that may be surface mounted.

It is a further objective of the present invention to provide a power chip resistor that is stable over time.

It is a further objective of the present invention to provide a power chip resistor that does not melt a solder connection.

It is a further objective of the present invention to provide a power chip resistor that uses a thick film resistant element.

It is a further objective of the present invention to provide a power chip resistor that is flow solderable.

It is a further objective of the present invention to provide a power chip resistor that reduces manufacturing costs.

These and other objectives will become apparent from the following description.

SUMMARY OF THE INVENTION

The following disclosure describes a power chip resistor that is capable of requiring reduced board space and increased power dissipation. The invention provides for the stacking of a number of chip resistors in order to construct a power chip resistor with increased power dissipation while not needing to increase the amount of board space occupied by the resistor. The invention uses an inert encapsulant such as glass to separate power chip resistors and uses a plating on the ends of the power chip resistor such as nickel so that solder will not melt.

DETAILED DESCRIPTION OF AN EXEMPLARY EMBODIMENT

Figure 1:
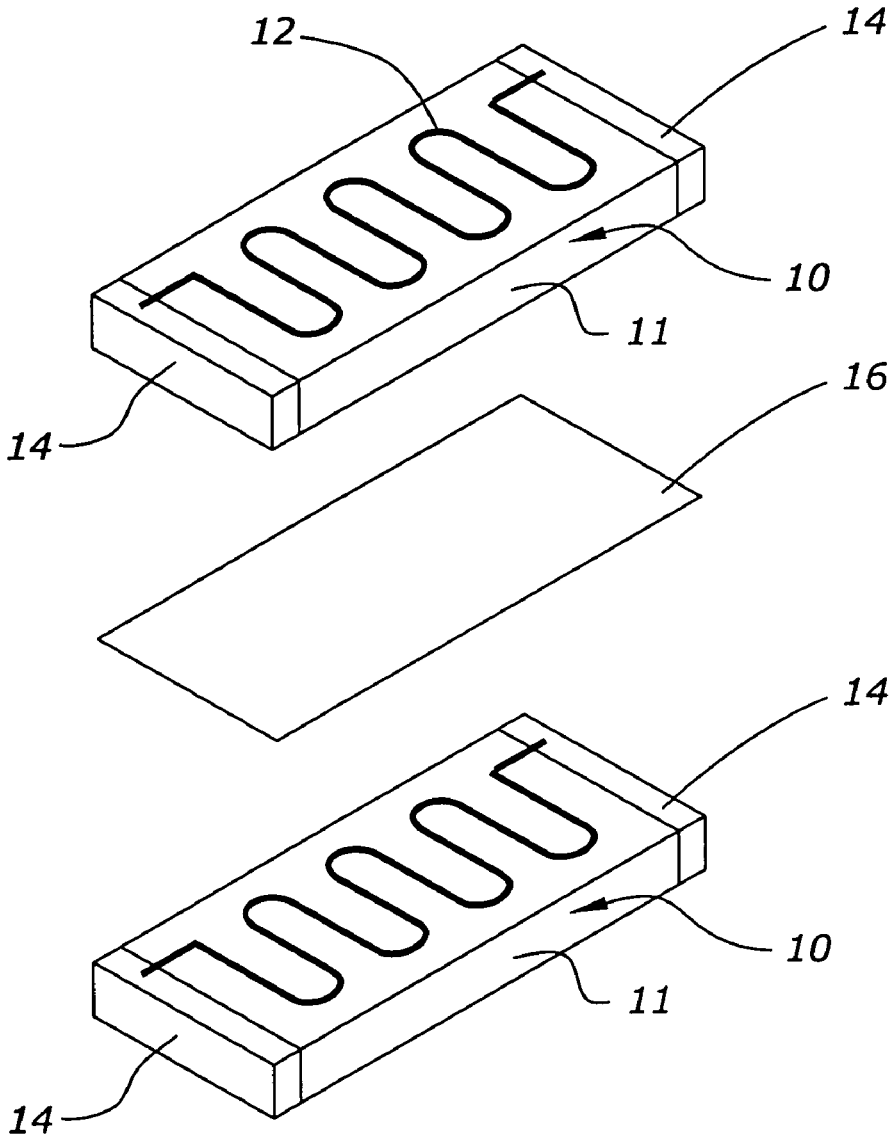
FIG. 1 is an exploded view of the power chip resistor of the present invention having a stack of two chip resistors.

FIG. 1 is diagram showing an exploded view of the power chip resistor of the present invention. In FIG. 1, two chip resistors 10 are shown. Each power chip may be of an internationally standard size although the present invention contemplates custom sizes as well. Each chip resistor is a thick film power chip resistor. The thick film power chip resistor has a resistive element 12. This resistive element is a thick film resistive element and preferably is ruthenium oxide. The thick film resistor preferably has an alumina substrate 11. The present invention is not limited to the particular type of film resistor and the present invention contemplates that other types of material may be used for the resistive element and for the substrate.

Each power chip resistor 10 also has electrical terminals or end caps 14. The terminals or end caps are of palladium silver or other conductor or metal or metal alloy that is known in the art.

Between each power chip resistor 10 is a layer of glass frit 16. The present invention contemplates that an encapsulant such as glass or other inert material may be used. The encapsulant provides the advantage of insulating the power chip resistor 10 without concern for long term instability such as may be caused by resistive heating.

Figure 2:
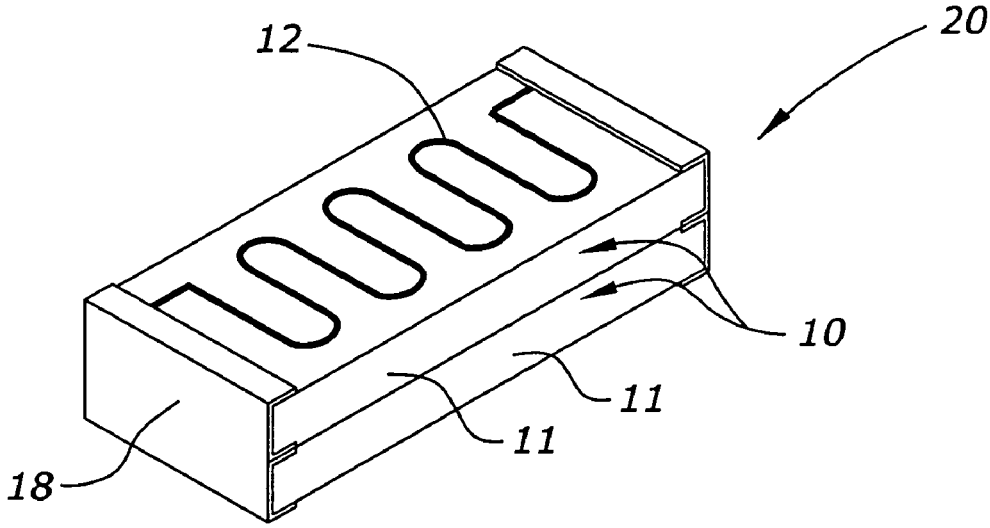
FIG. 2 is a diagram of the power chip resistor of the present invention having a stack of two chip resistors.

FIG. 2 best shows a stacked power chip resistor 20 of the present invention. Once the power chip resistors 10 have the layer of encapsulant 16 in place, a nickel barrier 18 is used. The nickel barrier plates the end caps 14. The nickel barrier provides for both electrical and mechanical connection of the power chip resistors within the stack. The nickel plating is conductive so that the nickel plating ensures electrical connections between the corresponding terminals of each power chip resistor that is stacked. Each power chip resistor in the stack is electrically in parallel with the other power chip resistors in the stack. The nickel plating also serves to mechanically bond together the power chip resistors in the stack so that there is mechanical stability even though epoxy or other adhesive is not used.

Nickel is preferred due to its high specific heat capacity. The high specific heat capacity of the nickel plating allows additional heat to be absorbed by the stacked power chip resistor and leads to higher power ratings. The present invention contemplates that other conductors with high specific heat capacity could be used as suggested by the particular application and specifications for a particular use. The use of nickel instead of solder precludes melting of the plating and end caps at higher temperatures and higher power levels.

Figure 3:
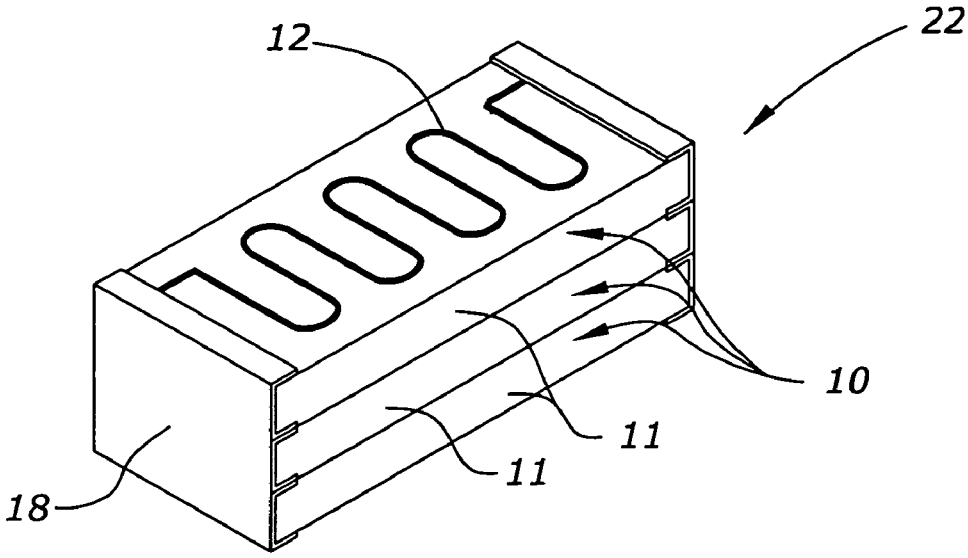
FIG. 3 is a diagram of the power chip resistor of the present invention having a stack of three chip resistors.
Figure 4:
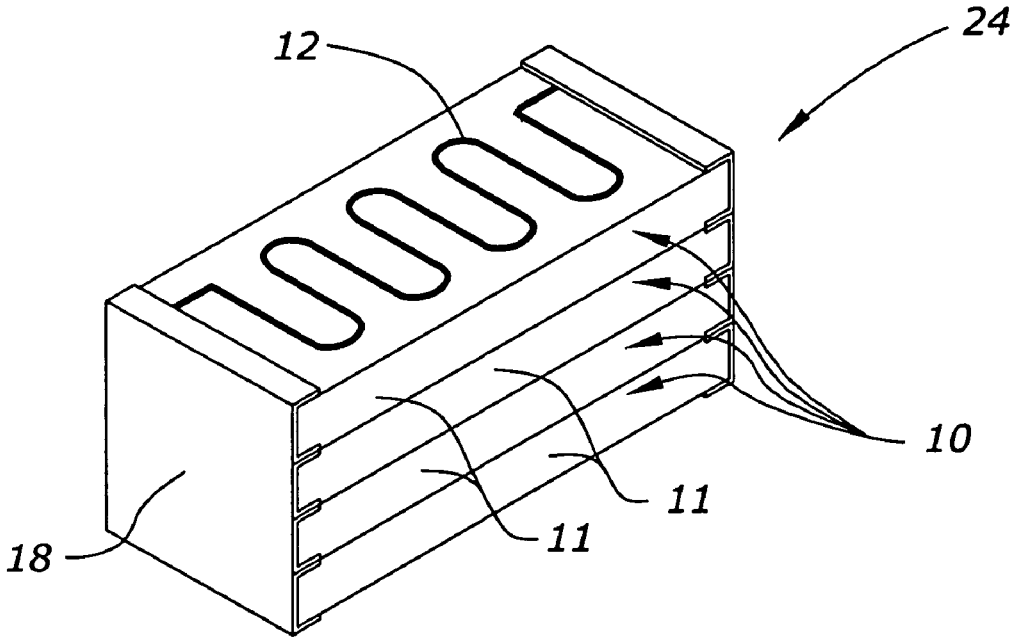
FIG. 4 is a diagram of the power chip resistor of the present invention having a stack of four chip resistors.

As shown in FIG. 3, the present invention contemplates variations in the number of power chip resistors that are stacked. FIG. 3 shows a triple stack power chip resistor 22. FIG. 4 shows a quadruple stacked power chip resistor 24. By increasing the number of power chip resistors that are stacked, the size of the stacked power chip resistor increases without requiring additional board space. This increase in size also increases the amount of heat that can be dissipated by the power chip resistor and thus increases the power range of the resistor. This increase in power range is approximately proportional to the increase in size of the power chip resistor.

When stacked, the size of the stacked power chip resistor need only change in thickness. Thus for example, in one standard size used in surface mount components, the length of the power chip resistor is 0.250 inches as measured from barrier to barrier. The width of the stacked power chip resistor is 0.056 inches and the thickness of the stacked power chip resistor is dependent upon the number of power chip resistors in the stack. Thus a double stack resistor would have a thickness of 0.056 inches, a triple stack would have a thickness of 0.085 inches, and a quadruple stack would have a thickness of 0.114 inches. These sizes are given by way of example only, to show that the amount of board space required is independent of whether the stacked power chip resistor is double stacked, triple stacked, or quadruple stacked. The present invention contemplates any size such as may be an international standard or that may be a custom size.

The present invention also contemplates operation over a wide range of resistance ranges, power ranges, and voltage ratings and is in no way limited by the particular choice of these specifications, as these specifications may be suggested by a particular environment or use.

Thus, an apparatus and method for a power chip resistor has been disclosed. It will be readily apparent to those skilled in the art that the present invention fully contemplates variations in the stacking of multiple power chip resistors, the choice of materials, and other modifications in the present invention.

What is claimed is:

1. A power chip resistor comprising:

a first and second film resistor each having (a) a substrate with a top surface, a bottom surface, a first end surface, an opposing end surface, a first side surface and an opposing side surface, (b) a film resistive element on the top surface of each substrate, (c) an end cap on the first end surface and electrically connected to the film resistive element, (d) a second end cap on the opposing end surface and electrically connected to the film resistive element, and (e) each end cap extending onto the top surface, the bottom surface, the first side surface and the second side surface;

the second film resistor of approximately the same physical size as the first film resistor, the second film resistor of approximately the same orientation as the first film resistor;

an inert encapsulant of glass frit between the top surface of the first film resistor and the bottom surface of the second film resistor;

a first nickel barrier plating electrically connecting the end cap on the first end surface of the substrate of the first film resistor and the first end surface of the substrate of the second film resistor and mechanically bonding the film resistors without adhesive or solder;

a second nickel barrier plating electrically connecting the second end cap on the second end surface of the substrate of the first film resistor and the second end cap on the second end surface of the substrate of the second film resistor and mechanically bonding the film resistors without adhesive or solder;

whereby the first and second nickel barrier plating used to connect the end caps and the encapsulant provide long-term mechanical stability and resistance to resistive heating;

wherein the power chip resistor is flow solderable due to the resistance to resistive heating provided by the first and second nickel barrier plating;

wherein the power chip resistor is formed by separating the first film resistor from the second film resistor with the inert encapsulant, connecting the end cap on the first end surface of the first film resistor with the end cap on the first end surface of the second film resistor using the first nickel barrier plating, and connecting the end cap on the second end surface of the second film resistor with the end cap on the second end surface of the second film resistor using the second nickel barrier plating, the first and second nickel barrier plating mechanically bonding the film resistors without adhesive or solder.

2. The power chip resistor of claim 1 wherein the film resistive elements are thick film resistive elements.

3. The power chip resistor of claim 1 wherein the film resistive elements comprise ruthenium oxide.

4. A power chip resistor comprising:

a first and second film resistor each having (a) a substrate with a top surface, a bottom surface, a first end surface, an opposing end surface, a first side surface and an opposing side surface, (b) a film resistive element on the top surface of each substrate, (c) an end cap on the first end surface of each surface electrically connected to the film resistive element, and (d) a second end cap on the opposing end surface of each substrate and electrically connected to the film resistive element; a glass frit encapsulant between the top surface of the substrate of the first film resistor and the bottom surface of the substrate of the second film resistor;

a first metal barrier plating covering and being electrically connected to the end caps on the first end surface of the substrate of the first and second film resistors and mechanically bonding the film resistors without adhesive or solder;

a second metal barrier plating covering and being electrically connected to the second end caps on the opposing end surface of the substrate of the first and second film resistors and mechanically bonding the film resistors without adhesive or solder to provide long term mechanical stability and resistance to resistive heating;

wherein the power chip resistor is flow solderable due to the resistance to resistive heating provided by the first and second metal barrier plating; and wherein the power chip resistor is formed by separating the first and second film resistor with the glass frit encapsulant, connecting the end cap on the first end surface of the first film resistor with the end cap on the first end surface of the second film resistor using the first metal barrier, and connecting the end cap on the second end surface of the first film resistor with the second end surface of the second film resistor using the second metal barrier.

5. The power chip resistor of 4 wherein the first and second metal barriers comprise a nickel alloy.

6. The power chip resistor of 5 wherein the first and second metal barriers comprise nickel.

7. The power chip resistor of claim 4 wherein the film resistive elements comprise ruthenium oxide.

8. The power chip resistor of claim 4 further comprising:

a third film resistor having (a) a substrate with a top surface, a bottom surface, a first end surface, an opposing end surface, a first side surface and an opposing side surface, (b) a film resistive element on the top surface of the substrate, (c) an end cap on the first end surface electrically connected to the film resistive element, and (d) a second end cap on the opposing end surface and electrically connected to the film resistive element;

a second encapsulant of glass frit between the top surface of the substrate of the second film resistor and the bottom surface of the substrate of the third film resistor, the first nickel barrier electrically connected to the end cap of the first end surface of the third film resistor, the second nickel barrier electrically connected to the second end cap on the second end surface of the third film resistor.

9. The power chip resistor of claim 8 further comprising:

a fourth film resistor having (a) a substrate with a top surface, a bottom surface, a first end surface, an opposing end surface, a first side surface and an opposing side surface, (b) a film resistive element on the top surface of the substrate, (c) an end cap on the first end surface electrically connected to the film resistive element, and (d) a second end cap on the opposing end surface and electrically connected to the film resistive element; a third encapsulant of glass frit between the top surface of the substrate of the third film resistor and the bottom surface of the substrate of the fourth film resistor, the first nickel barrier electrically connected to the end cap of the first end surface of the fourth film resistor, the second nickel barrier electrically connected to the second end cap on the second end surface of the fourth film resistor.

10. A stacked chip resistor comprising:

a first chip resistor and a second chip resistor, each chip resistor having a substrate with a thick film resistive element attached to the substrate, a first end cap and a second end cap, each end cap being an electrical terminal connected to the thick film resistive element and fully covering a first or second end surface of the substrate;

a layer of glass frit placed between the first chip resistor and the second chip resistor;

a first nickel barrier plating, the nickel barrier plating electrically connecting and surrounding the first end cap of the first chip resistor and the first end cap of the second chip resistor;

a second nickel barrier plating, the nickel barrier plating electrically connecting and surrounding the second end cap of the first chip resistor and the second end cap of the second chip resistor;

the nickel barriers bonding the chip resistors without adhesive and thereby providing long-term mechanical stability and resistance to resistive heating;

wherein the power chip resistor is flow solderable due to the resistance to resistive heating provided by the first and second nickel barrier plating; and wherein the stacked chip resistor is formed by separating the first and second chip resistors with the glass fit, connecting the first end cap on the first chip resistor with the first end cap or the second chip resistor, and using the first nickel barrier plating connecting the second end cap of the first chip resistor with the second end cap of the second chip resistor using the second nickel barrier plating.

11. The stacked chip resistor of claim 10 wherein the first film resistor and the second film resistor further have ruthenium oxide resistive elements.

12. The stacked chip resistor of claim 10 wherein each end cap is a silver alloy.

13. The stacked chip resistor of claim 12 wherein each end cap is a silver palladium.

14. The stacked chip resistor of claim 10 further comprising:

a third chip resistor, the third chip resistor having a substrate with a thick film resistive element attached to the substrate, a first end cap and a second end cap, each end cap being an electrical terminal connected to the thick film resistive element;

a second layer of glass frit placed between the second chip resistor and the third chip resistor, the first nickel barrier electrically connected to the first end cap of the third chip resistor, the second nickel barrier electrically connected to the second end cap of the third chip resistor.

15. The stacked chip resistor of claim 14 further comprising:

a fourth chip resistor, the fourth chip resistor having a substrate with a thick film resistive element attached to the substrate, a first end cap and a second end cap, each end cap being an electrical terminal connected to the thick film resistive element, the second chip resistor, and the third chip resistor;

a third layer of glass frit placed between the third chip resistor and the fourth chip resistor, the first nickel barrier electrically connecting the first end cap of the fourth chip resistor with the first end cap of the first chip resistor and the first end cap of the second chip resistor and the first end cap of the third chip resistor, the second nickel barrier electrically connected to the second end cap of the fourth chip resistor.

16. A power chip resistor comprising:

a first and second film resistor each having (a) a substrate with a top surface, a bottom surface, a first end surface, an opposing end surface, a first side surface and an opposing side surface, (b) a film resistive element on the top surface of each substrate, (c) an end cap on the first end surface coveting substantially all of the first end surface, and electrically connected to the film resistive element, (d) a second end cap on the opposing end surface coveting substantially all of the opposing end surface and electrically connected to the film resistive element, and (e) each end cap extending on to the top surface, the bottom surface, the first side surface and the second side surface;

the second film resistor of approximately the same physical size as the first film resistor, the second film resistor of approximately the same orientation as the first film resistor;

an inert encapsulant between the top surface of the first film resistor and the bottom surface of the second film resistor;

the inert encapsulant separating the top surface of the first film resistor and the bottom surface of the second film resistor such that the top surface of the first film resistor is not in contact with the bottom surface of the second film resistor;

a first barrier electrically connecting the end cap on the first end surface of the first film resistor and the first end surface of the second film resistor and mechanically bonding the film resistors without adhesive;

a second barrier electrically connecting the second end cap on the second end surface of the first film resistor and the second end cap on the second end surface of the second film resistor and mechanically bonding the film resistors;

the first barrier extending from the portion of the first end cap on the top surface of the first film resistor to the portion of the first end cap on the bottom surface of the second film resistor;

the second barrier extending from the portion of the second end cap on the top surface of the first film resistor to the portion of the second end cap on the bottom surface of the second film resistor;

whereby the first and second barrier provide long-term mechanical stability and resistance to resistive heating; and wherein the power chip resistor is formed by separating the first and second film resistor with the inert encapsulant, mechanically joining the first and second film resistor and the encapsulant by connecting the end cap on the first end surface of the first film resistor with the end cap on the first end surface of the second film resistor using the first barrier, and connecting the end cap on the second end surface of the first film resistor with the end cap on the second end surface of the second film resistor using the second barrier.

17. A stacked power chip resistor, comprising:

a first chip resistor and a second chip resistor, each chip resistor comprising a substrate, a resistive element on the substrate and first and second end caps electrically connected to opposite ends of the resistive element;

an inert encapsulant between the first chip resistor and the second chip resistor;

a first barrier mechanically connecting the first end cap of the first chip resistor and the first end cap of the second chip resistor to provide long term mechanical stability in a manner resistant to resistive heating;

a second barrier mechanically connecting the second end cap of the first chip resistor and the second end cap of the second chip resistor to provide long term mechanical stability in a manner resistant to resistive heating; and wherein the stacked chip resistor is formed by separating the first and second chip resistors with the inert encapsulant, joining mechanically the first and second barriers and the inert encapsulant by connecting the first end cap on the first chip resistor with the first end cap on the second resistor, using the first barrier connecting the second end cap of the first chip resistor with the second end cap of the second chip resistor using the second barrier.

* * * * *

UNITED STATES PATENT AND TRADEMARK OFFICE

CERTIFICATE OF CORRECTION

PATENT NO. : 7,038,572 B2
APPLICATION NO. : 09/811844
DATED : May 2, 2006
INVENTOR(S) : Huber et al.

It is certified that error appears in the above-identified patent and that said Letters Patent is hereby corrected as shown below:

Claim 10, Col. 6, line 16:
the first and second chip resistors with the glass "fit" should read --frit--.

Signed and Sealed this

Eleventh Day of July, 2006

JON W. DUDAS
*Director of the United States Patent and Trademark Office*